US006588183B1

(12) United States Patent
Romagnoli

(10) Patent No.: US 6,588,183 B1
(45) Date of Patent: Jul. 8, 2003

(54) DEVICE FOR COMPACTING AND HOLDING A LOOSE SOLID SUBSTANCE, DOSED AT REGULAR INTERVALS, ON A MOBILE CONVEYOR BELT WHICH IS PERMEABLE TO AIR

(75) Inventor: Andrea Romagnoli, San Lazzaro di Savena (IT)

(73) Assignee: Technomeccanica S.r.L., Bologna (IT)

( * ) Notice: Subject to any disclaimer, the term of this patent is extended or adjusted under 35 U.S.C. 154(b) by 0 days.

(21) Appl. No.: 09/526,095

(22) Filed: Mar. 15, 2000

(30) Foreign Application Priority Data

Mar. 26, 1999 (IT) ..... BO99A0144

(51) Int. Cl.[7] ..... B65B 55/00

(52) U.S. Cl. ..... 53/510; 53/512; 53/117; 53/520; 53/548

(58) Field of Search ..... 53/510, 512, 117, 53/520, 539, 548, 528, 134.2, 526, 550, 568; 493/123, 101, 418

(56) References Cited

U.S. PATENT DOCUMENTS 3,736,722 A 6/1973 Rosenberg 5,871,789 A 2/1999 Romagnoli

FOREIGN PATENT DOCUMENTS

| | | |
|---|---|---|
| EP | 806353 | 11/1997 |
| GB | 1022021 | 3/1966 |
| IT | 1279697 | 12/1997 |

*Primary Examiner*—Eugene Kim
*Assistant Examiner*—Sameh Tawfik
(74) *Attorney, Agent, or Firm*—Fay, Sharpe, Fagan, Minnich & McKee, LLP

(57) ABSTRACT

A device for compacting, on a first conveyor belt which is permeable to air, a solid substance consisting of loose particles, deposited in doses at regular intervals by dosing means which are synchronized with the first conveyor belt, comprises a second conveyor belt which moves at the same speed as and is located below the first belt, the second belt having through-holes at intervals along its length corresponding with the intervals used to deposit the doses of the substance; and vacuum means which are in continuous communication with the holes so that, through the first conveyor belt, they exert suction on the doses of the substance, keeping the particles of the substance together and in contact with the conveyor belt below them.

4 Claims, 4 Drawing Sheets

DEVICE FOR COMPACTING AND HOLDING A LOOSE SOLID SUBSTANCE, DOSED AT REGULAR INTERVALS, ON A MOBILE CONVEYOR BELT WHICH IS PERMEABLE TO AIR

BACKGROUND OF THE INVENTION

The present invention relates to the packaging of loose solid substances, whether foodstuffs or pharmaceutical products, and in particular relates to a device for automatically packaging tea, chamomile, and/or similar herbal products for infusion in bags made of filter paper.

In general product packaging technology, there is an established tendency to keep reducing the quantity of material used to make the product packet, while the actual amount of product contained in the packet remains unchanged. In the tea sector, this means a constant search for, on one hand, new bag shapes, whose production requires reduced quantities of filter paper to contain the same dose; and on the other hand, a search for new technical solutions and production devices which allow an increase in the amount of the product which can be contained in a bag with a precise given shape and dimensions.

The sector for obtaining packets which allow greater economy with materials, in particular, filter paper, includes a machine designed by the Applicant (see patent IT-1.279.697) which forms tea bags in a succession of stages which envisage: dosing the tea on a single continuous web of filter paper using a special dosing wheel whose edge makes direct contact with the web; folding the continuous web of filter paper over itself lengthways; overlapping the folded edges of the web in such a way that the successive doses of tea contained inside it are wrapped up; sealing the overlapping edges of the web, around the doses; and finally, cutting the web into sections corresponding to the individual bags of the product. The dosing wheel allows the doses of tea to be kept relatively compact around the depositing zone and the use of a single web of material, folded over itself, allows a reduction in the quantity of paper used.

The tea bags made using this machine, therefore, have quite a low amount of packaging material per product unit packaged. However, this already advantageous aspect must be further modified in the continued effort to reduce the amount of packaging materials used.

Moreover, this machine, like all known machines which heat-seal filter paper, has the disadvantage that it is impossible to rule out the possibility that the particles of tea may move away from the zone where the dose is deposited, due to machine vibrations, and may then remain between the sealed edges of the bags, on one hand causing disadvantages to bag feed during their formation, and on the other hand sometimes rendering the appearance of the finished bag unsuitable.

SUMMARY OF THE INVENTION

The main aim of the present invention is to allow an increase in the amount of product which can be contained in a bag with a preset capacity.

A further aim of the present invention is to prevent particles of the product from moving away from the zone in which the doses are deposited and reaching the zones to be heat-sealed.

Accordingly, the present invention achieves these aims by providing a device for compacting, on a first conveyor belt, made of a material which is permeable to air, in particular consisting of a web of filter paper which moves with a linear velocity V, a solid substance, consisting of loose particles, deposited in doses at regular intervals by dosing means which are synchronized with the linear velocity V of the first conveyor belt. The device comprises a second conveyor belt, which moves at the same speed as the first and is located below the latter. The second conveyor has through-holes along its length, at intervals which correspond with the intervals at which the doses of the substance are deposited on the first belt; and vacuum means which are in continuous communication with the holes in the second belt in such a way that, through the first belt, they exert a suction on the doses of the substance which compacts the doses and keeps the particles packed tightly together and in contact with the first belt below them.

Thanks to the fact that the doses are held on the first conveyor belt, that is to say, the web of filter paper of which it consists, the device allows an increase in the operating speed of the packaging machines to which it is fitted.

In fact, this method of holding the tea in a compact form allows the packaging machine to be pushed to its highest possible mechanical operating speeds, without fear of disadvantages or deterioration in the quality of the product which could be caused by the corresponding increase in the level of machine vibrations.

The low level vacuum required to hold the doses of tea in place also means that the above-mentioned advantages can be obtained with a small amount of energy and relatively low costs for production of the device.

BRIEF DESCRIPTION OF THE DRAWINGS

Further characteristics of the invention, in accordance with the above-mentioned aims, are set out in the claims herein and the advantages more clearly illustrated in the detailed description which follows, with reference to the accompanying drawings, which illustrate a preferred embodiment without limiting the scope of application, and in which:

DESCRIPTION OF THE PREFERRED EMBODIMENTS

With reference to the accompanying drawings, the numeral 1 indicates as a whole a device for compacting a substance consisting of loose solid particles, for example tea, chamomile or herbal products for infusion. The device is preferably used in automatic packaging machines which prepare the doses 7 of the substance and package them in bags 10 made of filter paper.

Figure 1:
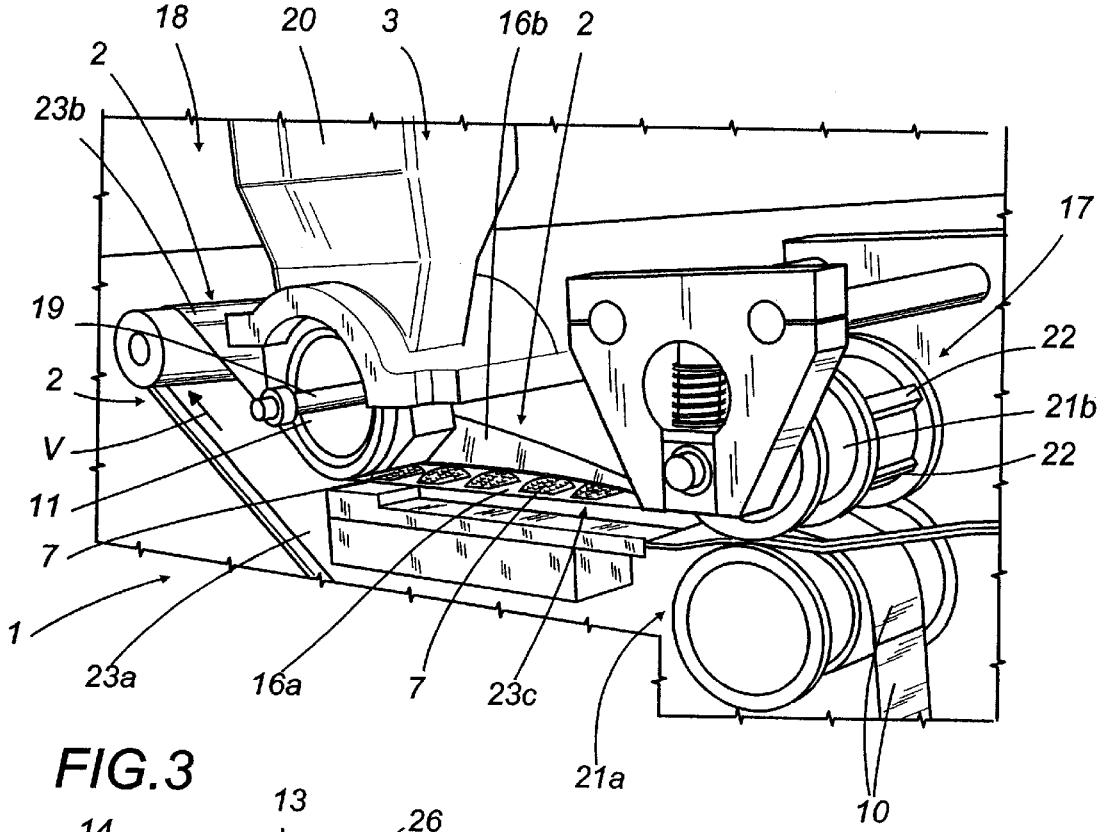
FIG. 1 is a perspective assembly view of the device illustrated on a packaging machine of the known type.

In the embodiment in FIG. 1, the device 1 is attached to an automatic packaging machine, of the known type, substantially between the packaging machine dosing station 18 and the sealing station 17.

The dosing station 18 comprises a dosing wheel 11 which rotates about a horizontal shaft 19, with a container 20 holding the substance to be packaged at the base. There are compartments 25 designed to hold the substance located at suitable intervals 6 along the edge of the wheel.

The sealing station 17 (which in the embodiment described is a station for sealing the web of filter paper) has a pair of drive rollers 21*a,* 21*b* whose edges make contact with one another and which are fitted with conventional sealing elements 22.

The device 1 basically comprises two conveyor belts 2, 4 which are connected to vacuum means.

A first conveyor belt 2 consists of a web of filter paper, for example of the heat-sealable type, which is permeable to air, used to make bags 10 which contain the substance. The web of filter paper is fed and unwound in a continuous fashion from a roll (not illustrated) along a complex path which brings it into contact with the edge of the dosing wheel 11 and which includes two oblique sections 23*a,* 23*b,* one after another, followed by a substantially horizontal section 23*c* located between the dosing wheel 11 and the drive rollers 21*a,* 21*b*.

The first conveyor belt 2 moves forward with a linear speed which is synchronized with the peripheral speed of the dosing wheel 11.

Figure 4A:
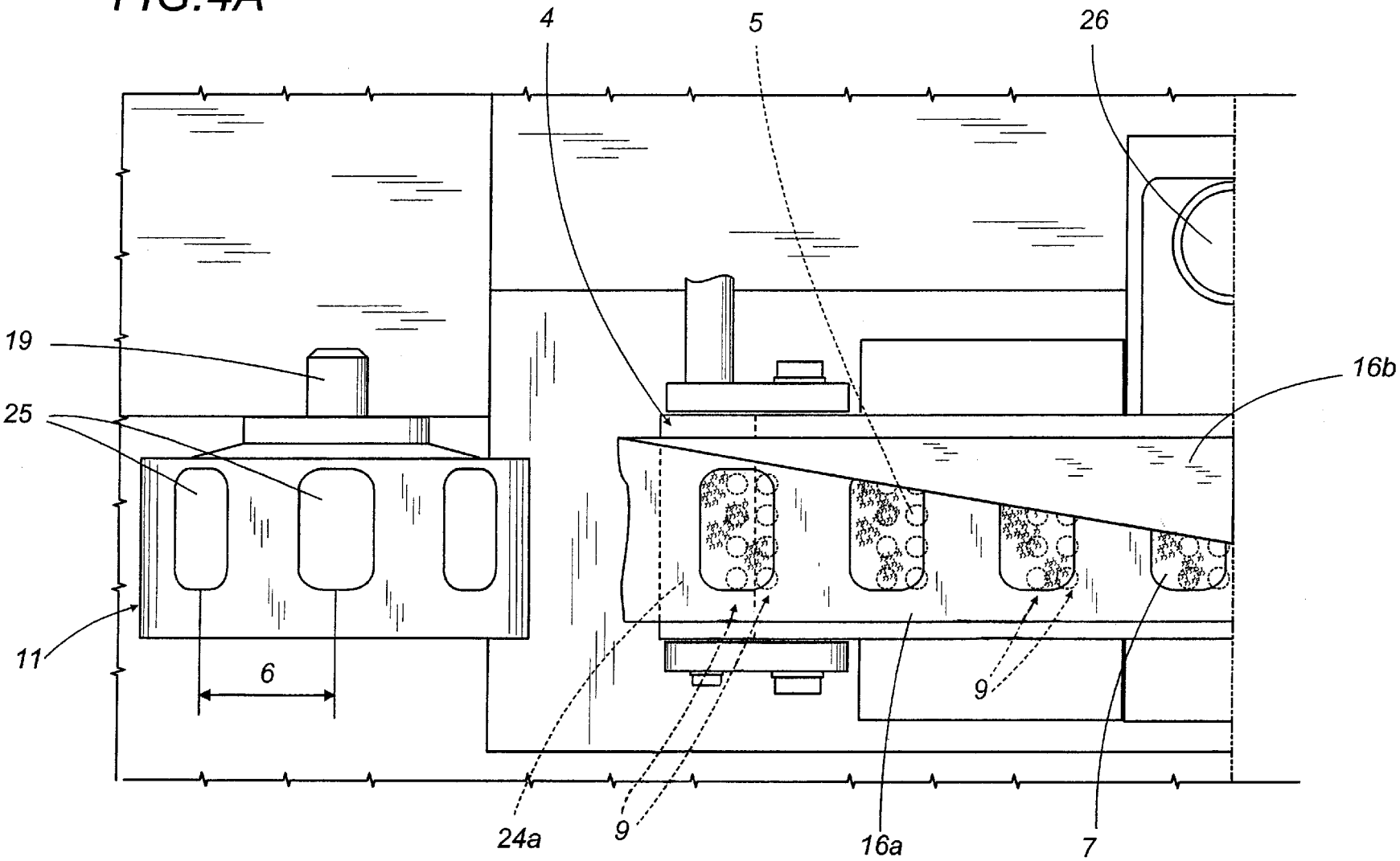
FIGS. 4A and 4B are scaled-up top plan views of matching parts of the device which can be positioned side-by-side.
Figure 4B:
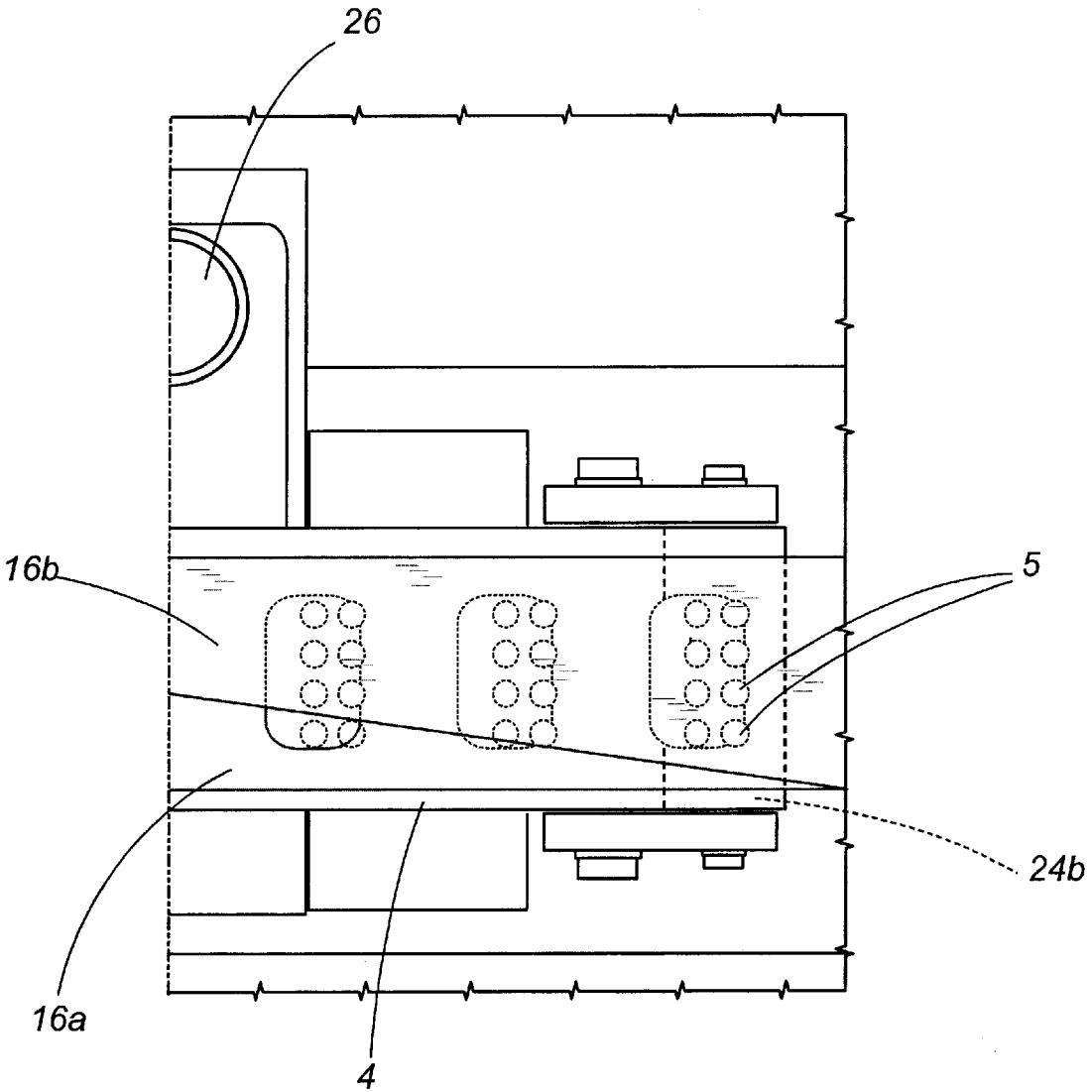
Figure 5:
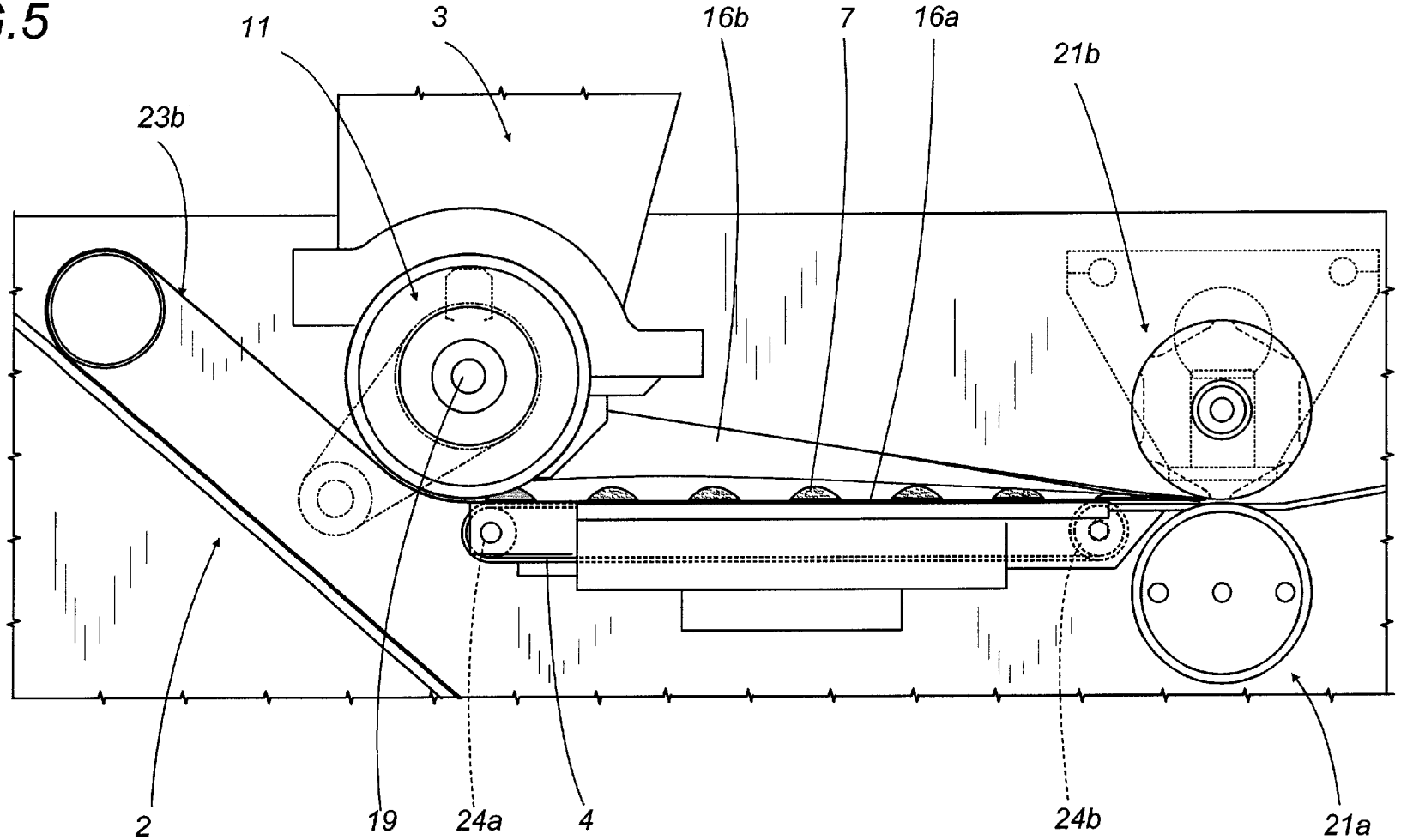
FIG. 5 is an elevation view of the device illustrated in FIGS. 4A and 4B.

The second belt 4, which is below the horizontal section 23*c* of the first belt 2, is closed in a loop extending horizontally and circumscribes two pulleys 24*a,* 24*b* (FIGS. 4A, 4B and 5), one of which is motor-driven. One end of the second belt 4 is located below the dosing roller 11, whilst the other end is immediately upstream of the sealing station 17.

The second conveyor belt 4 moves at the same speed as the first belt 2 and has a set of through-holes 5 at intervals 6 along its length which correspond to the intervals on the edge of the dosing wheel 11 which, as is more clearly described below, correspond to the depositing of the doses 7 of the substance on the first conveyor belt 2. The holes 5 in the second conveyor belt 4 are also aligned in parallel rows 9, across the second belt 4.

Figure 3:
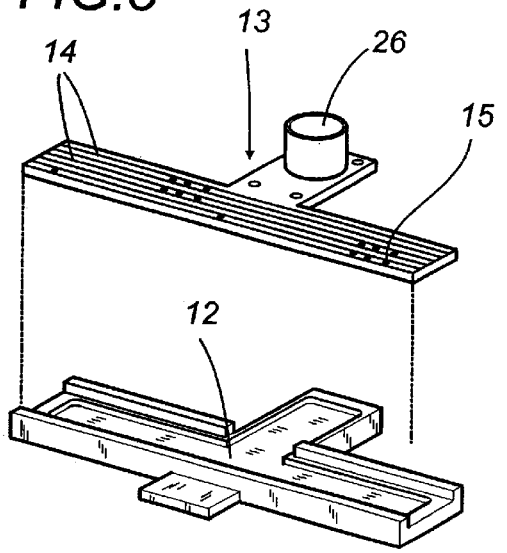
FIG. 3 is an exploded perspective view of the device illustrated in FIG. 1.
Figure 2:
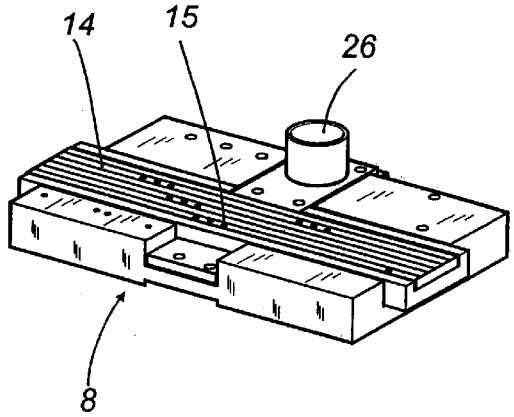
FIG. 2 is a perspective assembly view of the device, with some parts cut away to better illustrate others.
Figure 2:
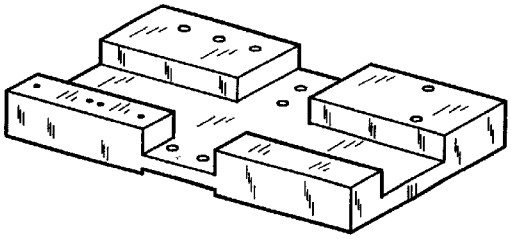

The vacuum means, labeled 8 as a whole, are located below the second belt 4 and comprise a chamber 12 (see FIGS. 2 and 3) with a lid 13. The outside of the lid has a set of parallel grooves 14, set side-by-side and communicating with the chamber 12 below by means of holes 15 through the lid 13. The grooves 14 are set side-by-side at distances corresponding to those between the holes 5 in a single row 9 in the second belt 4 and allow communication between the holes 5 in the second belt 4 and the chamber 12.

The lid 13 also has a tube 26 which connects the chamber 12 to external means designed to produce a given vacuum inside the chamber 12.

In practice, the device 1 operates with the vacuum means 8 constantly switched on, therefore, as the dosing wheel 11 gradually deposits the doses 7 of the substance at regular intervals on the first conveyor belt 2, the suction effect exerted by the chamber 12 on the doses 7, through firstly the holes 5 in the second belt 4 and then the natural pores of the filter paper, compacts the individual loose particles about the position in which the doses 7 are released. The doses 7, therefore, behave as if they were a solid body and adhere to the web of paper over the entire transfer path to the sealing station 17. As it travels along the horizontal section 23*c,* the web of filter paper is gradually folded lengthways over itself so as to define two surfaces 16*a,* 16*b* on the same web. The lower surface 16*a* supports the doses 7 in their compact form, whilst the upper surface 16*b* gradually formed overlaps the doses 7 which are, therefore, gradually closed between the two surfaces 16*a,* 16*b*.

When the first belt 2 arrives at the sealing station 17, the surfaces 16*a,* 16*b* of the web of paper are sealed together around the doses 7 of the substance, forming a continuous set of bags 10 which proceed towards the machine for further processing.

The invention described can be subject to modifications and variations without thereby departing from the scope of the inventive concept. Moreover, all the details of the invention may be substituted by technically equivalent elements.

What is claimed is:

1. A device for compacting, on a first, mobile conveyor belt which is permeable to air, a solid substance consisting of loose particles, said device comprising:

a first mobile conveyor belt which is permeable to air and moves in a downstream direction;

dosing means synchronized with the first conveyor belt for depositing a solid substance consisting of loose particles in doses at regular intervals on said first conveyor belt;

a second closed-loop continuous conveyor belt which moves at the same speed as the first conveyor belt in the downstream direction and is located below the first conveyor belt, there being a plurality of through-holes defined through the second conveyor belt at intervals corresponding to the regular intervals at which the doses of the substance are deposited on the first conveyor belt, said through-holes arranged in multiple spaced-apart rows that extend across the second conveyor belt in a direction transverse to said downstream direction; and, vacuum means which communicate with the holes in the second conveyor belt so that said vacuum means exert suction on the solid substance through the first conveyor belt to compact the doses and keep the loose particles of the substance together and in contact with the first conveyor belt, said vacuum means fixed in position relative to said first and second conveyor belts and comprising a chamber with a lid over which said first and second conveyor belts move, the lid defining grooves extending in the downstream direction that communicate with the chamber by means of through-holes defined in the lid, the grooves being set side-by-side at distances corresponding to distances between the holes in said plurality of rows of holes defined in the second conveyor belt that moves over said lid.

2. The device according to claim 1, in which the first conveyor belt consists of a web of filter paper which is fed in a continuous fashion and gradually folded over to enclose the doses of the substance and make bags which contain the substance which consists of a product for infusion.

3. The device according to claim 2, further comprising a sealing station located downstream relative to said vacuum means for sealing the bags.

4. The device according to claim 2, wherein said dosing means comprises a rotary dosing wheel having an edge that makes contact with and moves at the same speed as the first conveyor belt.

* * * * *

UNITED STATES PATENT AND TRADEMARK OFFICE

CERTIFICATE OF CORRECTION

PATENT NO. : 6,588,183 B1
DATED : July 8, 2003
INVENTOR(S) : Andrea Romagnoli

It is certified that error appears in the above-identified patent and that said Letters Patent is hereby corrected as shown below:

Title page,
Item [73], Assignee, please add the name -- [73] Assignee: Tecnomeccanica S.r.L., Bologna (IT) --

Signed and Sealed this

Twenty-first Day of June, 2005

JON W. DUDAS
*Director of the United States Patent and Trademark Office*